US006082868A

United States Patent [19]

Carpenter

[11] Patent Number: 6,082,868

[45] Date of Patent: Jul. 4, 2000

[54] COLOR ANIMATED AIR CIRCULATING FAN

[76] Inventor: Duane Carpenter, 214 N. Lincoln Ave., Clearwater, Fla. 33755

[21] Appl. No.: 09/183,264

[22] Filed: Oct. 30, 1998

[51] Int. Cl.[7] ..... F21V 33/00

[52] U.S. Cl. ..... 362/96; 362/35; 362/84; 362/260; 416/5; 472/61; 472/72; 40/430; 40/431; 40/502

[58] Field of Search ..... 362/96, 84, 260, 362/35; 416/5; 472/61, 72; 40/430, 431, 502, 541, 582

[56] References Cited

U.S. PATENT DOCUMENTS 4,342,073 7/1982 Ranten ..... 362/294

5,028,206 7/1991 Kendregan ..... 416/5

5,205,636 4/1993 Carpenter ..... 362/84

*Primary Examiner*—Cassandra Spyrou

*Assistant Examiner*—Leo Boutsikaris

[57] ABSTRACT

The present invention is an air circulating fan which creates optical displays. The fan comprises a housing in a generally circular configuration with a central axis. Also provided is a propeller formed of a plurality of blades mounted for rotational movement within the housing about an axis of rotation coincident with the central axis of the housing, the blades have exposed surfaces with fluorescent paint thereon. A light source is located within the housing in operative proximity to the blades disseminating light from the blades. Further included is a drive mechanism to rotate the blades and a power source to illuminate the light source.

5 Claims, 7 Drawing Sheets

FIG 26
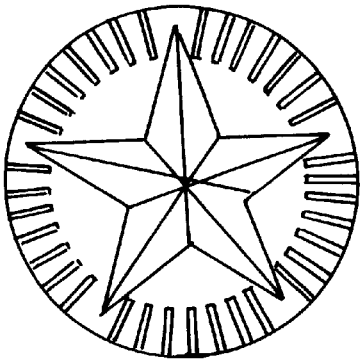
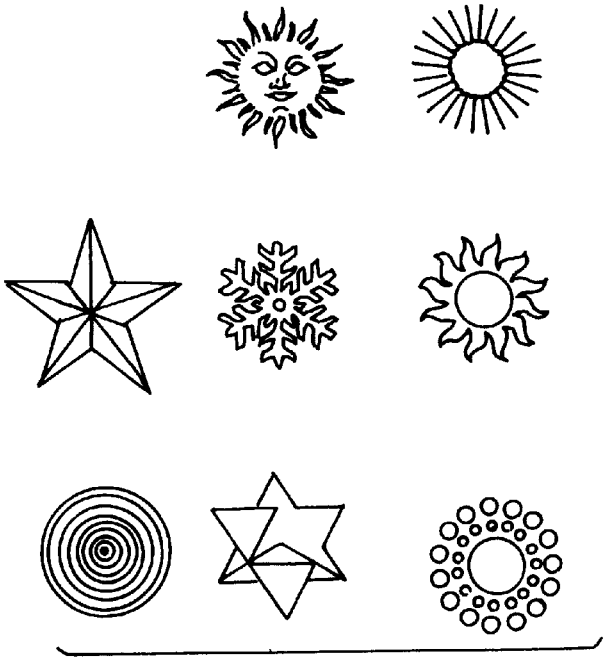
FIG 25
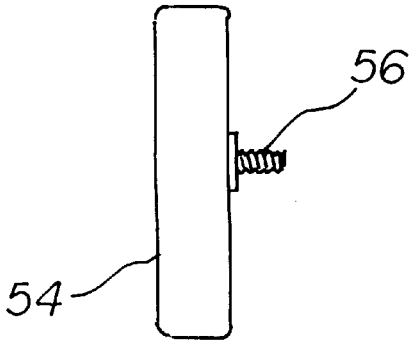
FIG 27

COLOR ANIMATED AIR CIRCULATING FAN

BACKGROUND OF THE INVENTION

1. Field of the Invention

The present invention relates to a new and improved optical display device and, more particularly, pertains to an air circulating fan which provides relaxation and entertainment to a viewer.

2. Description of the Prior Art

The use of fans, lights, and display devices of known designs and configurations is known in the prior art. More specifically, fans, lights, and display devices of known designs and configurations heretofore devised and utilized for the purpose of providing entertainment and relaxation to viewers through known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of fans, lights, and display devices of known designs and configurations. By way of example, U.S. Pat. No. 5,005,110 to Brotz, issued Apr. 2, 1991, discloses an electrostatic display device. U.S. Pat. No. 5,028,206 to Kendregan et al., issued Jul. 2, 1991, discloses an illuminated ceiling fan. U.S. Pat. No. 5,072,341 to Huang, issued Dec. 10, 1991, discloses a lamp assembly suspended from a ceiling fan. U.S. Pat. No. 5,082,422 to Wang, issued Jan. 21, 1992, discloses an illuminative fan. U.S. Pat. No. 5,205,636 to Carpenter, issued Apr. 27, 1993, discloses a rotating display. U.S. Pat. No. 5,224,830 to Wang, issued Jul. 6, 1993, discloses a holographically-decorated ceiling fan. U.S. Pat. No. 5,437,540 to Blocker et al., issued Aug. 1, 1995, discloses an illuminated blade, ceiling fan apparatus. U.S. Pat. No. 5,470,205 to Conklin, Jr., issued Nov. 28, 1995, discloses a decorative fan blade. U.S. Pat. No. 5,528,469 to Todd, Jr., issued Jun. 18, 1996, discloses a light assembly for a ceiling fan. U.S. Pat. No. 5,672,002 to Todd, Jr., issued Sep. 30, 1997, discloses a light assembly for a ceiling fan. U.S. Pat. No. 5,704,145 to Hanitz, issued Jan. 6, 1998, discloses a point of purchase spinning display. Lastly, U.S. Pat. No. 5,738,587 to Dykstra, issued Apr. 14, 1998, discloses a machine for producing optical illusions. The following expired patents are of interest: U.S. Pat. No. 3,245,310, to Aldcroftt, issued Apr. 12, 1966, discloses an apparatus and process for producing visual images. U.S. Pat. No. 3,272,506 to Lescher, issued Sep. 13, 1966, discloses a pattern for generating the subjective effect of color.

In this respect, the air circulating fan display of the present invention substantially departs from the conventional concepts and designs of the prior art, and in doing so provides a fan apparatus primarily developed for the purpose of providing air circulation, relaxation and entertainment to a viewer.

Therefore, it can be appreciated that there exists a continuing need for a new and improved optical display device which can be used for providing air circulation, relaxation and entertainment to a viewer. In this regard, the present invention substantially fulfills this need.

SUMMARY OF THE INVENTION

In view of the foregoing disadvantages inherent in the known types of fans, lights, and display devices of known designs and configurations now present in the prior art, the present invention provides a new and improved fan and optical display device. As such, the general purpose of the present invention, which will be described subsequently in greater detail, is to provide a new and improved fan with optical displays which have all the advantages of the prior art and none of the disadvantages.

To attain this, the present invention essentially comprises a new and improved fan with optical displays which provides relaxation and entertainment for a viewer. The invention includes a housing in a generally circular configuration with a central axis and a generally C-shaped cross-sectional configuration around the periphery forming an interior annular chamber and positionable in a generally vertical plane. Also included is a propeller formed of a plurality of blades mounted for rotational movement within the housing radially interior of the chamber about an axis of rotation coincident with the central axis of the housing. The blade has at least one exposed surface with fluorescent paint thereon visible to observer radially interiorly of the chamber. A knock-off hub is adapted to removably secure the propeller to the housing, the knock-off hub having an interior light source for use in disseminating light upon the florescent paint of the blades. A light source is located within the housing radially exterior of the blades disseminating a black light on the fluorescent paint of the blades. Further included is a drive mechanism to rotate the blades with adjustment mechanisms under the control of a user to vary the speed of rotation of the blades during operation and use. Lastly, the invention includes a power source to illuminate the light source with adjustment components under the control of a user to vary the intensity of the light source during the rotation of the blade.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fan with optical displays which has all the advantages of the prior art fans, lights, and display devices of known designs and configurations and none of the disadvantages.

It is another object of the present invention to provide a new and improved optical display device which may be easily and efficiently manufactured and marketed.

It is a further object of the present invention to provide a new and improved fan with optical displays which is of a durable and reliable construction.

An even further object of the present invention is to provide a new and improved fan with optical displays which is susceptible of a low cost of manufacture with regard to both materials and labor, and which accordingly is then susceptible of low prices of sale to the consuming public, thereby making such fan economically available to the buying public.

Even still another object of the present invention is to provide relaxation and entertainment to a viewer.

Lastly, it is an object of the present invention to provide a fan with optical displays which comprises a housing in a generally circular configuration with a central axis. Also provided is a propeller formed of a plurality of blades mounted for rotational movement within the housing about an axis of rotation coincident with the central axis of the housing, the blade having exposed surfaces with fluorescent paint thereon. A light source is located within the housing in operative proximity to the blades disseminating light from the blades. Further included is a drive mechanism to rotate the blades and a power source to illuminate the light source.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 25 illustrates various knock-off hub designs which can be employed with the fan device of the present invention.

FIG. 26 is a detailed view of one of the knock-off hubs that can be employed with the present invention.

FIG. 27 is a side elevational view of the knock-off hub of FIG. 26.

The same reference numerals refer to the same parts throughout the various Figures.

DESCRIPTION OF THE PREFERRED EMBODIMENT

Figure 1:
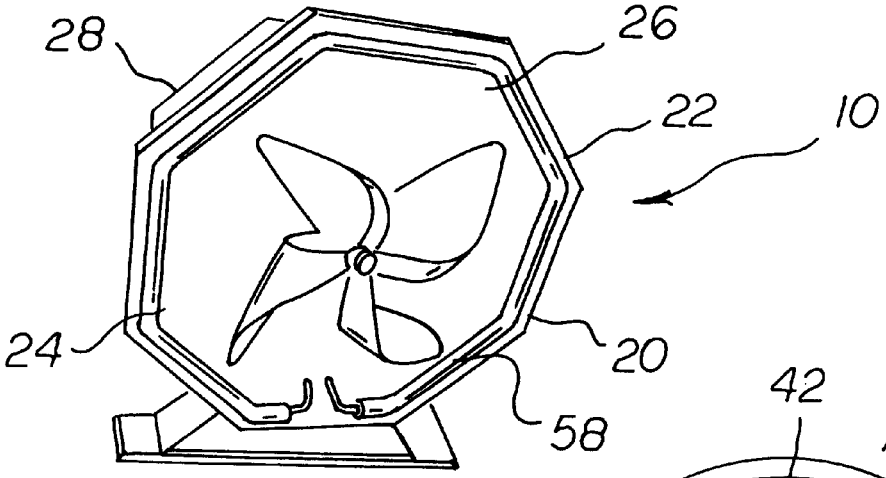
FIG. 1 is a prespective illustration of the new and improved fan with optical displays constructed in accordance with the principles of the present invention.

With reference now to the drawings, and in particular to FIGS. 1 through 29 thereof, the preferred embodiment of the new and improved fan with optical displays, or optical display device, embodying the principles and concepts of the present invention and generally designated by the reference numeral 10 will be described. In general terms, the present invention relates to a fan device which employs a rotational member off of which light is reflected. Various decorative propeller blades can be utilized in conjunction with the present invention to yield various optical effects. The various components of the present invention, and the manner in which they interrelate, will be described in greater detail hereinafter.

Figure 3:
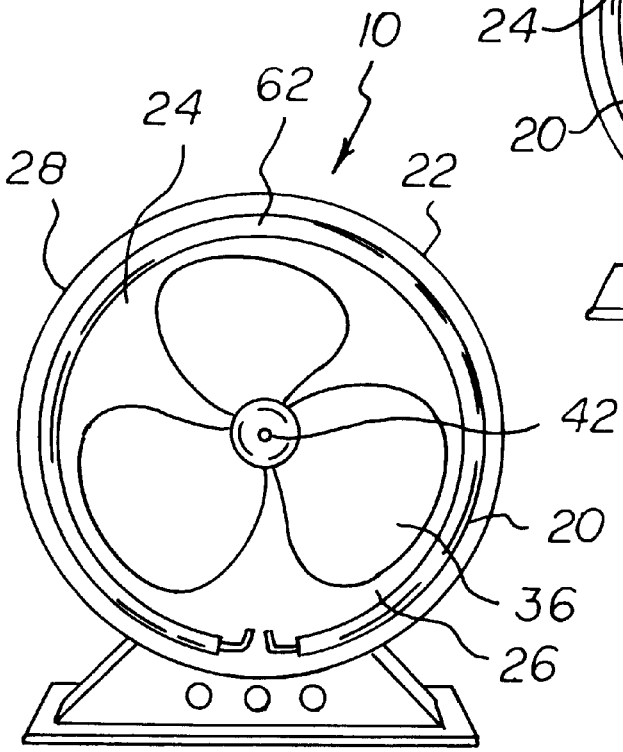
FIG. 3 is a perspective illustration of a fan with optical displays wherein the central hub does not contain a light source.

With reference now to FIG. 3, a new and improved fan device 10 for providing relaxation and entertainment is depicted. Such fan device includes a housing 20 formed from a generally circular configuration. Such housing 20 is defined by a central axis in a generally C-shaped cross-sectional configuration about the periphery 22. This housing 20 forms an interior annular chamber 24 which is positionable in a generally vertical plane. As with the other components of the present invention, this housing 20 can be constructed from a wide variety of materials. The preferred material, however, is plastic. Additionally, although a circular housing has been described, it is within the scope of the invention to use housings of other shapes and/or designs. For example, FIG. 1 illustrates a housing in an octagon configuration.

Figure 4:
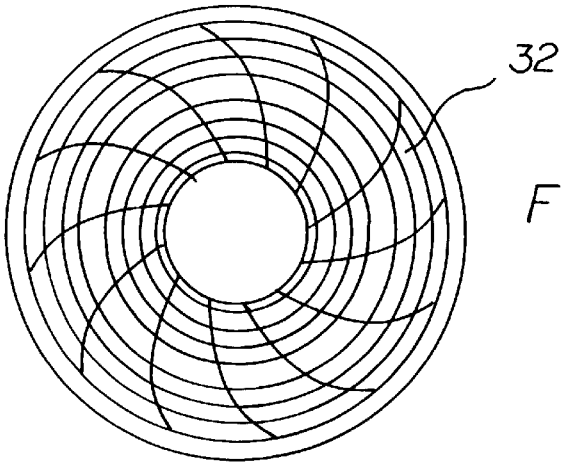
FIG. 4 is an illustration of a clear plastic grill which is adapted to fit over the front of the housing.
Figure 5:
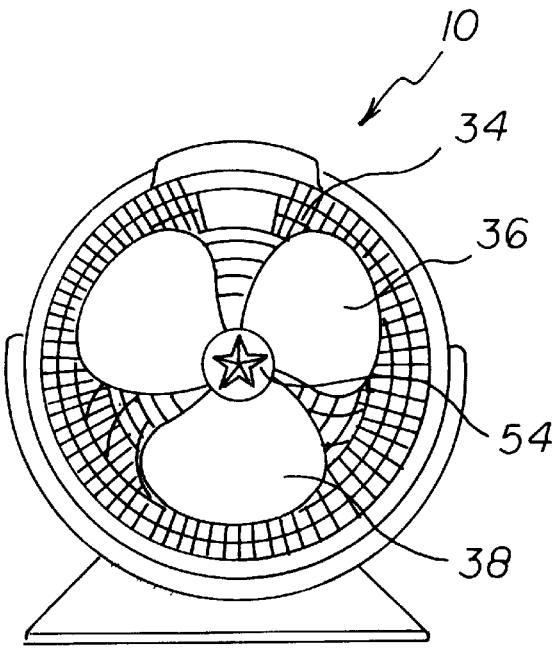
FIG. 5 is an illustration of a fan with optical displays wherein the back cover employs a plurality of perforations.
Figure 6:
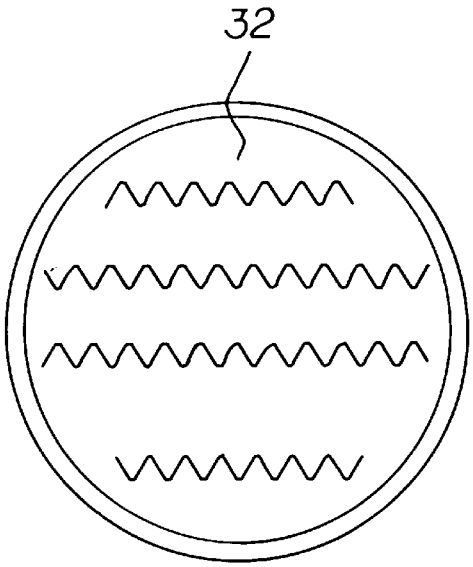
FIG. 6 is a view of a transparent non-perforated cover for use on the front of the fan device.

The housings of FIGS. 1 and 3 both include a front and a rear face (26 and 28 respectively) which can be enclosed through use of a suitable cover. With reference now to FIG. 4, one possible front cover 32 is depicted. This cover 32 is transparent such as not to interfere with a user's viewing the fan device 10. Additionally, this front cover 32 is formed from a transparent material and employs a grill so as to allow air flow through the front of the fan device 10. The front grill of FIG. 4, however, could alternatively be composed of thin piano wire, florescent or clear fish line, each of which would allow for minimum distortion and maximum visibility of the artwork on the blades. FIG. 5 illustrates a rear cover 34 which is opaque and in the form of a grill so as to allow for air flow out of the rear face 28 of the fan device 10. When such rear cover 34 is employed, the-front cover 32 can be a solid non-apertured cover. Such a non-apertured cover is illustrated with reference to FIG. 6.

The air flow which is generated by the fan device 10 is created by a propeller 36 which is adapted for rotational movement within the housing 20. In the preferred embodiment, the propeller 36 is formed from a plurality of blades 38 and is located radially interior of the chamber 24. Furthermore, any propeller 36 used would have an axis of rotation 42 which is coincident with the central axis of the housing 20. FIGS. 1 through 3 and 5 through 7 show the relationship between the propeller blades 38 and the surrounding housing 20. The optical effects generated by the present invention are created, in part, by having at least one exposed surface of the blade 38 of the propeller painted with a florescent color. Such painting is done to ensure that the florescence is visible to an observer who is looking radially interiorly of the chamber.

Figure 9:
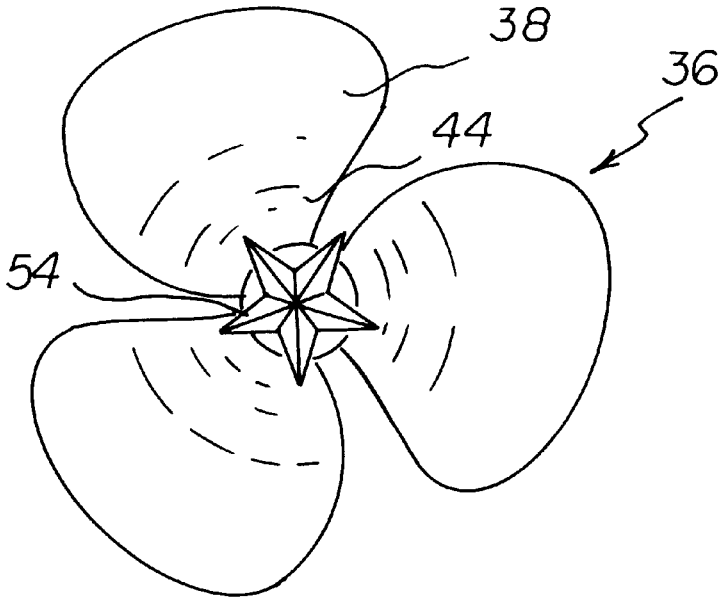
FIG. 9 is a front elevational view of one possible decorative blade and center knock-off hub which can be employed with the optical display device of the present invention.
Figure 10:
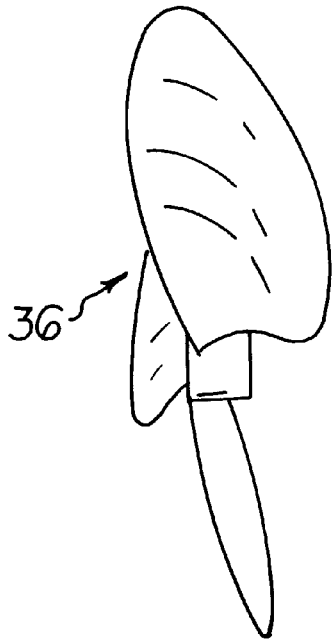
FIG. 10 is a side elevational view of the blade of FIG. 9.
Figure 11:
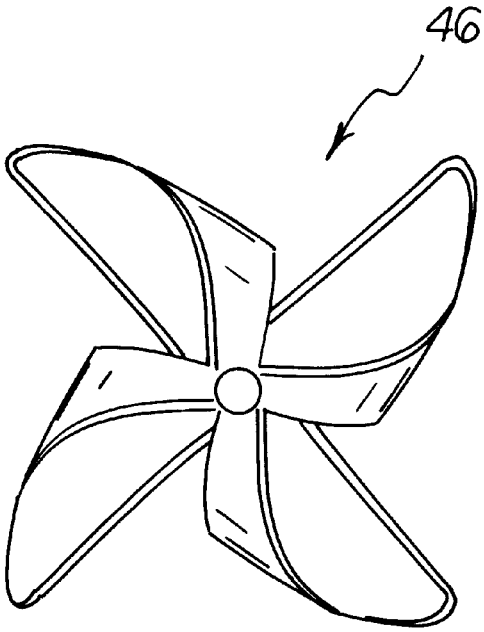
FIG. 11 is a view of a pinwheel-type blade that can be employed with the fan of the present invention.
Figure 12:
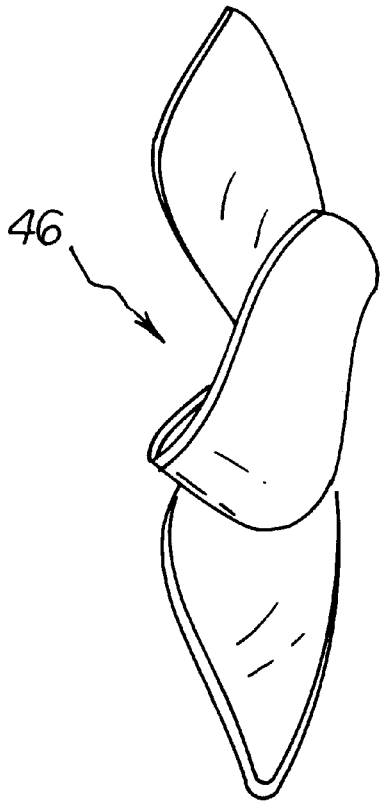
FIG. 12 is a side elevational view of FIG. 11.
Figure 13:
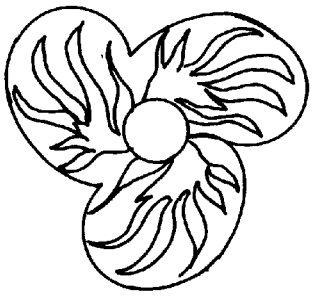
FIGS. 13 through 24 show various decorative arrangements for blades which can be used in conjunction with the fan device of the present invention.
Figure 14:
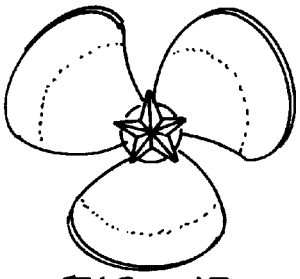
Figure 15:
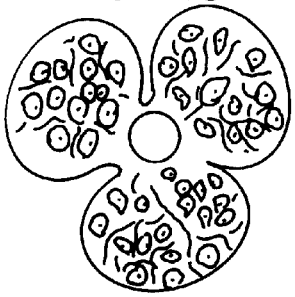
Figure 16:
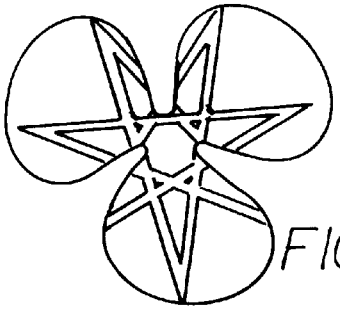
Figure 17:
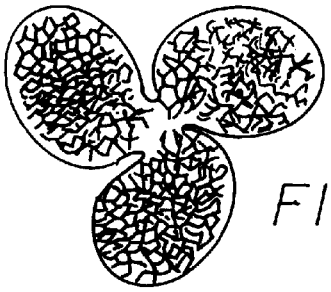
Figure 18:
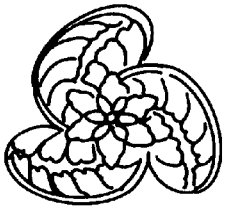
Figure 19:
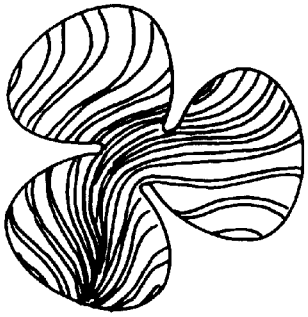
Figure 22:
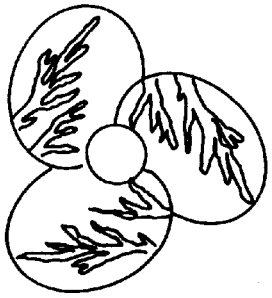
Figure 23:
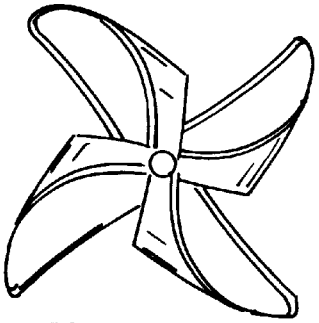

Thus, various optical effects can be generated through the use of different colored phosphorescent paints, or different painting designs. Additionally, even more optical effects can be achieved through employing different blade geometries. For example, FIGS. 9 and 10 illustrate a blade with a graded phosphorescence 44 painted thereon. Alternatively, FIGS. 11 through 12 show a blade which is in the form of a pinwheel 46. Namely, each blade of the propeller is folded over to form a closed loop. FIG. 13 shows a blade decorated with a fire-type design; FIG. 14 again shows a graded phosphorescent painting arrangement; FIG. 15 illustrates a blotted painting arrangement; FIG. 16 shows a blade decoration employing various geometrical shapes; FIG. 17 shows a painting design which gives a contoured multi-dimensional effect; FIG. 18 shows a seashell or flowered type painted design; FIG. 19 shows a waved painting arrangement; FIG. 22 illustrates a lightening bolt painted design; and FIG. 23 shows a painted pinwheel. Thus, each of these various painted designs would yield different optical effects as they are rotated within the interior of the housing.

Figure 20:
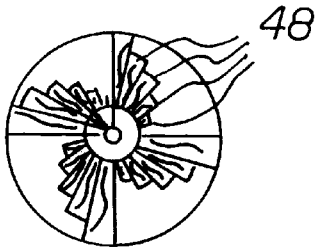
Figure 21:
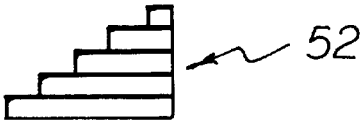
Figure 24:
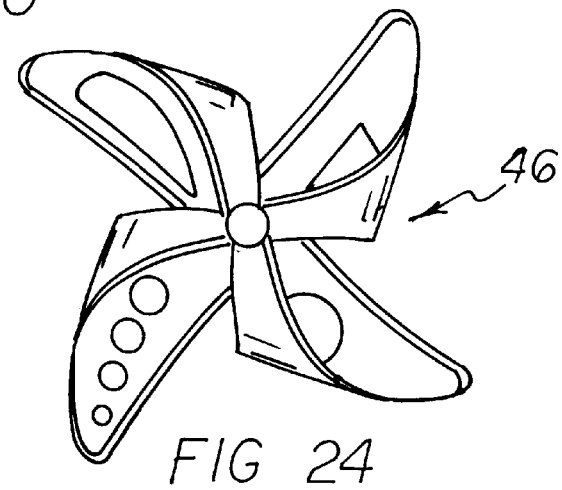

Other techniques, however, can be employed to generate other unique optical effects. For example, FIGS. 20 and 21 illustrate a painted blade design which would give an animated effect when rotated. Furthermore, the blade of FIG. 20 includes a series of segments 48 which are provided in a step arrangement 52. FIG. 21 is a cross-sectional view of one quadrant of the blade and illustrates the progressive height of successive segments or steps 48. Each of the segments 48 is painted with a design which is incrementally changed from successive segments. For example, FIG. 20 is painted with the successive segments containing progressively larger flames. Thus, rotation of the blade creates the visual effect of an animated flame which flickers up and down. Although the animated effect has been described in conjunction with a flame, other animated designs could obviously be employed. For example, the successive segments could be painted with a bird's wings with successive segments depicting different wing positions. Thus, rotation of the blade would result in the animated wing flapping. Additionally, although the animated effect has been described in conjunction with successive steps of increasing height, such is not necessary to achieve animation. Lastly, FIG. 24 illustrates an alternative embodiment to the pinwheel-type blade depicted in FIG. 23. Specifically, FIG. 24 includes individual blades with various cutouts. Namely, the pinwheel blades contain circular, oval, rectangular or a series of oval cutouts. Such cutouts again serve to generate unique optical effects and to miinimize air flow which, in turn, further increases the mechanical efficiency.

The propellers 36 are removably interconnected to the axis of the housing 20 by way of various knock-off hubs 54. Such knock-off hubs 54 are employed in removably securing the propeller 36 to a powered shaft rotatably secured to the interior of the housing 20. This securement is achieved through a threaded fastener 56 which forms one end of the knock-off hub 54. The threaded fastener 56 is adapted to be threadably secured within both the center of the propeller 36 and into the central axis of the housing 20. FIGS. 26 and 27 illustrate a knock-off hub 54 and its associated central fastener for use in securing a propeller blade 36 to the housing 20. Thus, the knock-off hub 54 allows a user to conveniently replace the propeller blade with another propeller blade of a different design. FIG. 25 illustrates various designs for the center knock-off hub 54.

Figure 2:
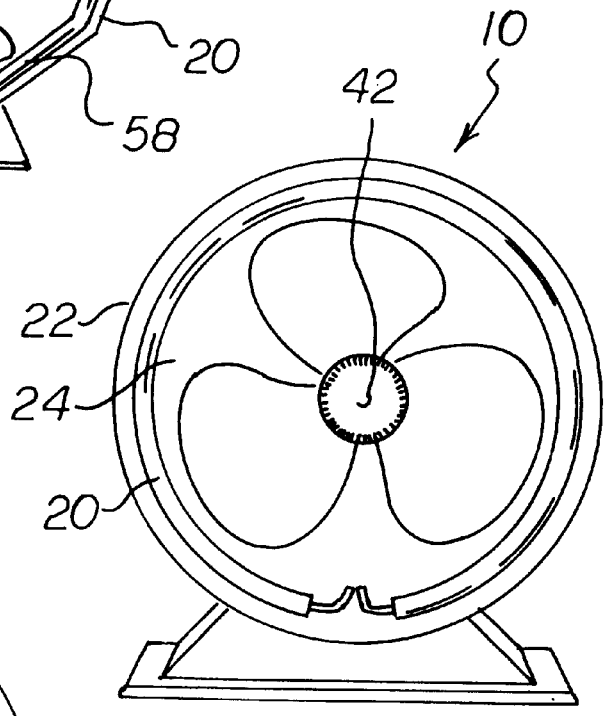
FIG. 2 is a perspective illustration of a fan with optical displays constructed in accordance with the principles of the present invention wherein the housing is circular and the central knock-off hub includes a light source.
Figure 7:
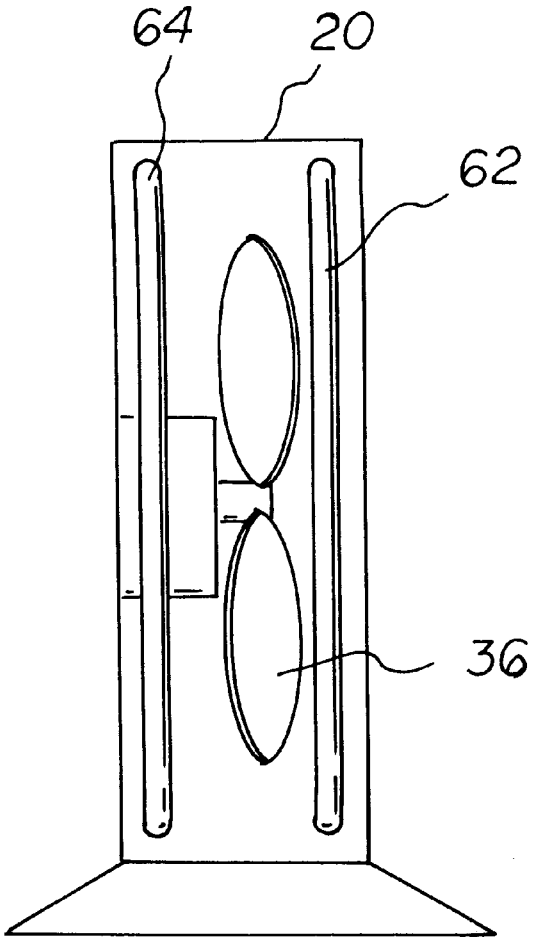
FIG. 7 is a side elevational view of the display device employing forward and rearward lights.
Figure 8:
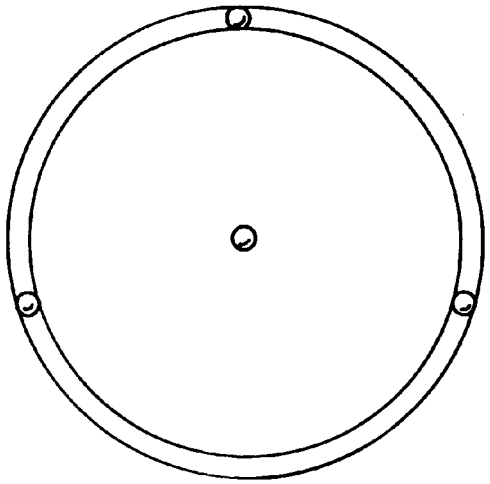
FIG. 8 is a view of a lighting structure employing a gang of three halogen bulbs.

The fan with optical displays of the present invention can also use various light sources located within the housing and in operative proximity to the blades for use in illuminating the propeller blades. FIG. 1 illustrates an octagon light source 58 which is located along the periphery 22 of the housing 20 radially exterior of the blades 38. Such light source serves to disseminate a black light on the florescent paint of the blades 38. FIG. 3 illustrates a similar light source 62 but of a circular configuration. Each of these light sources are located just inwardly of the radial periphery 22 of the housing 20 and thus radiate light inwardly upon the forward face of the blades 38. However, such light source can also be positioned at the rear of the propeller 36, thereby radiating light upon the rear face of the blades 38. Such a rear lit configuration works best with a blade which is at least partially transparent. FIG. 7 is a cross-sectional view of a fan device constructed in accordance with the principles of the present invention and illustrates both a forward and a rearward light source (62 and 64 respectively). Additionally, both FIG. 3 and FIG. 1 illustrate a continuous light source; however, the light sources can also be discrete. For example, FIG. 8 illustrates three separate light sources which are located upon the inner periphery of the housing. Whichever arrangement is employed, the light source can be either a black light, a halogen light, or a florescent light. Furthermore, as illustrated in FIG. 2, a light source can be included within the interior of the central hub. This centrally located light source would disseminate light upon the blades from the interior of the housing.

The fan device of the present invention also includes a drive mechanism which is employed to rotate the blades. Such drive mechanism, in the preferred embodiment, includes adjustment mechanisms which allow the user to control the speed and rotation of the blades during the use of the display device. Additionally, a power source is included for use in illuminating the light sources. As with the drive mechanism, these power sources can include adjustment components which would allow a user to control and vary the intensity of the light source during the rotation of the blade. A power source for powering the drive mechanism is also included. Each of the power sources can either be located within the device itself or, alternatively, be located remote from the device.

Figure 28:
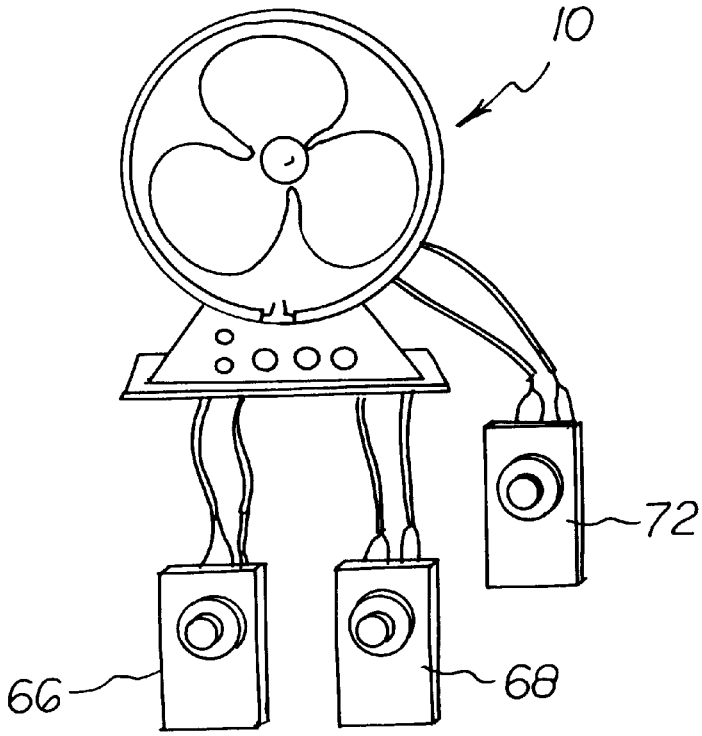
FIG. 28 is a view of the fan system with its associated controls.
Figure 29:
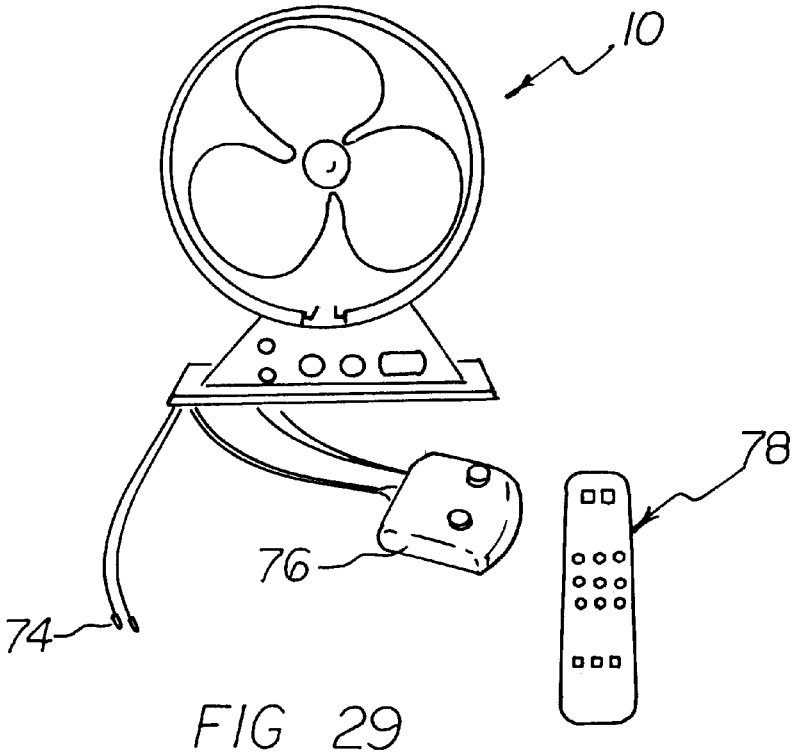
FIG. 29 is a view of the fan device with alternative controls.

FIGS. 28 and 29 illustrate the various control mechanisms which can be employed in altering the drive mechanism and/or the power sources. FIG. 28 discloses a first controller 66 for varying the speed of the fan, a second controller 68 for controlling the intensity of the light, and a third controller 72 for altering the rotation of the fan. FIG. 29 discloses still yet other controls which can be employed upon the fan device. For example, the fan unit can include preprogrammed electronic circuits for controlling the fan speed, light intensity and directional rotation through a preprogrammed arrangement. Furthermore, patch cords 74 can be included for interconnecting the fan device 10 to a computer or other such control means. Alternatively, such patch cords 74 could be employed to interconnect the fan device to a stereo system and/or video display such that the rotational speed, light intensity and rotational direction would be controlled on the basis of audio or visual inputs. FIG. 29 also discloses the three controls previously described in conjunction with FIG. 28 in a compact console arrangement 76, or in a remote control arrangement 78.

What has been described is a fan which functions as a work of art. The fan employs visual effects to create various moods in the mind of the observer.

The combination of an air circulating fan with a light facing towards the blades illuminating artwork thereon has an unusual and unsuspecting effect to the eye of the viewer. The present invention combines the practical utilitarian function of an air circulating fan the displaces air with the additional visual effects from the illuminated and colored blades.

The resulting spectacular and unusual visual effects are the result of a light source reflecting off of the colored blade while in motion. The light source can be a single blacklight, incandescent, halogen or a series of illuminated bulbs. A gang of three or more different types of lights can be run independently or simultaneously with other lighting systems for different special effects.

A separate light, halogen, incandescent, florescent or neon will be positioned in the center hub of the rotating blade. This bulb will help illuminate the central hub artwork which is the furthest from the other lights. The intensity and brightness of this bulb will be regulated in a manner similar to the other bulbs.

The illuminating light or lights can also be positioned behind the blade. The blade in this case will be either transparent or translucent for the light to pass through the blade and illuminate the colored pigment in or on front of the blade. When small quantities of florescent dies are added to the transparent plastic prior to the blades being formed, they will fluoresce when exposed to a blacklight.

The bulb of the present invention is positioned on the outer rim on the main frame of the fan and is covered with a housing or shroud. In this way the light is directed toward the fan blade located around the outer perimeter of the fan front housing. This shroud or housing prevents light from escaping outwardly towards the viewer yet simultaneously illuminates the blades that the viewer is watching.

The present invention, however, does differ from conventional fans with existing lights in that the light source is deliberately hidden and directed back towards the colored blades for a special visual effect. The light source is not directed down or away from the fan blades as in conventional ceiling fans.

Shields or reflective guards are often attached on ceiling light fixtures in an attempt to deflect the light away from the turning blades. The purpose of this outward and downward deflection is to illuminate the open space or room needing light and, at the same time, to prevent any illumination from the light reflecting off the blades which may cause a disorienting and/or distracting effect to the occupant of the room. Overhead air circulating fans rotate at a slower R.P.M., 0–200. The present invention operates at a higher speed of up to 2,500 R.P.M.'s. This additional speed, combined with the optical effect of the light pulsing of the blades, is what creates the pleasing effect for the viewer.

The colored blades can be custom designed for special visual effects. For example, the number of blades per unit, the angle of the blade varied as in a steeper angle of a pinwheel, or composing the blades of a flexible material that vibrates or oscillates while in rotation are all means of achieving varied effects. The pinwheel design will have holes or sections deleted from the blades so that there will be less resistance to air as it turns. The openings can be round, triangular or oblong.

The blades that are colored for these odd and unusual visual effects can also be at the similar pitch, contour and form of any conventional standard air circulating fan. The present invention agitates and drives in the desired direction the same amount of air as any conventional air circulating fan. Air direction and strength are not violated.

The special effects blades include: 1) a fire design; 2) air brushed bands; 3) marbleized design; 4) triangles; 5) geometric op art; 6) flower; 7) colored swirls; 8) equal armed cross diagram; 9) lightning bolts; 10) terraced sun ray; 11) animated pictures. The terraced sun ray has a series of stepped segments. Individual painted flames are painted on each of the terrace steps. thus, as the wheel turns the flames alternately go from one level to another giving a multi-dimensional animated effect. This terraced effect also creates no resistance as it turns because there is no angle to the blades. The animated pictures each have a blade with a number of separate appendages which can range from two appendages to 20. An identical picture or artwork will be on each separate appendage. Each one of these pictures will show a central theme to be in a slightly different position than the picture on the appendage before it. This picture can be a bird in flight, a horse galloping or a dancing geometric design. If the pictures of each of the subjects is changed slightly these pictures will appear as the fan blade turns to be in constant motion or animation. An example of this unique and novel idea would be a bird in flight. First the bird's wings will be positioned slightly downward on the first blade appendage. On the next or second appendage that follows, the turning blade will show the bird's wings positioned slightly lower. When the wings of the bird have reached the bottom of its stroking motion, the bird's wings will begin to reverse themselves and the next blade appendage will show the bird's wings on the upward stroke. When the wings have gone through the same sequence just outlined in reverse, and reached the maximum of their upstroke, they will once again begin to move downward. This constant upward and downward movement of the bird's wings through six different positions will give the bird an appearance of being in flight.

A clear plastic grill fits over the front and allows a protective shield against bodily injury from the rotating blades. Because of its transparent nature, this grill or mesh allows for full visual exposure of the rotating fan blade and its wide variety of colored and geometric patterns. Also provided is a clear protective shield without perforations. This shield allows the maximum of clear viewing. It is used with the reverse mode switch so that air can exit from the rear of the fan. When the temperature is cool this will allow air to move freely from the rear of the fan and not forward toward the viewer. All known fan blade covers are fabricated for the sole purpose of being a protective shield and do not allow for unobstructed visual eye contact of the interior blades.

The rear of the fan portion of the present invention is provided with an opaque protective shield that allows air to pass through but protects the operator from injury.

The present invention has an additional function of a knock-off hub which allows for quick and easy changing of the blades to create different effects. The knock-off hub fastens the blade to the fan. Any decorative artwork outlined in diagram and positioned on the front hub, stars for example, will have this knock-off hub underneath. The same artwork on the knock-off hub will be used on the blade design as outlined in the previous paragraph of special blade designs.

The present invention is provided with a number of different modes. Mode 1 controls the speed of the motor's R.P.M.'s, for example, low, medium or high. Separate controls are provided for intensity of illumination. A reverse mode switch allows the blade to operate in an opposite direction, thus forcing air out the back of the fan.

Mode 2 is a random mode that allows the motor of the present invention to move at varying pre-programmed speeds and with varying pre-programmed intensities of light. These pre-programmed modes can be electronically built into the fan base.

Mode 3 includes separate controls, for example patch cords or a key board, which allows the viewer to operate the fan through its wide variety of functions manually like a video game or interactive computer. The same effect can also be achieved by a remote control.

Mode 4 includes an electronic sensor built into the control panel of the present invention. This sensor receives any sound source as for example from a radio, cassette, compact disk, or video. The illumination quality and speed will move through a series of patterned intensities provided it by the frequency or the intensity of the signal that is heard or received.

The same effect outlined in Mode 4 may also be achieved by connecting patch cords from the present invention with its electronic sensor directly to a compact disk player, video cassette recorder, computer or stereo amplifier, AM or FM.

The various applications and usages of the present invention include the following.

1) The present invention can be connected to biofeedback sensors, brain waves, heartbeat, body temperature sensors or the like, so that by observing the present invention, one can orient positively any of these bodily functions. The viewer may then gain control over the physiological, emotional and psychological functions of the body for relaxation, meditation or stress reduction. The present invention may also be used for hypnosis. Its fluctuating rhythms and pulses can induce a hypnotic state.

2) The present invention may also be constructed in a larger model and utilized in movie theaters or theatrical playhouses. The present invention could also accompany musical symphonies and rock concerts.

3) The present invention may be manufactured in a kit format. The kit would consist of interchangeable blades which are constructed from different materials such as rubber, soft plastic, flexible polyurethane or the like. Additionally, the blades will be pitched at different angles and provided with different patterns to contribute to and enhance the different visual effects.

4) The present invention may also be utilized on a vehicle by attaching the blacklight portion under an automobile wheel well. The hub caps are specially designed with the aforementioned patterns using fluorescent colors. After dark, beautiful and pleasing effects are produced as the wheel turns.

5) The present invention may be utilized with any machine that turns at high speeds such as airplane propellers, helicopter blades or jet turbine engines.

6) The present invention could also utilize phosphorescent paint on the blades. This would produce a glow-in-the-dark effect without any additional illuminating light source. The blades could be painted metaflake or iridescent colors so that during the daylight hours or when the wheel is illuminated by an external source, the blades would glow and produce the same effects as described previously without any direct lighting source built within the fan itself.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved optical display fan device for providing relaxation and entertainment for a viewer comprising, in combination:

a housing in a generally circular configuration with a central axis and a generally C-shaped cross-sectional configuration with an outermost peripheral edge, the housing forming an interior annular chamber and positionable in a generally vertical plane;

a propeller formed of a plurality of blades mounted for rotational movement within the housing radially interior of the chamber about an axis of rotation coincident with the central axis of the housing, each blade having at least one exposed surface with fluorescent paint thereon visible to the viewer looking radially interiorly of the chamber;

a knock-off hub adapted to removably secure the propeller to the housing, the knock-off hub having an interior light source for use in disseminating light upon the flourescent paint of the blades;

a light source fixed within the housing to the outermost peripheral edge radially exterior of the blades disseminating a black light on the fluorescent paint of the blades;

a drive mechanism to rotate the blades with adjustment mechanisms under the control of a user to vary the speed of rotation of the blades during operation and use; and a power source to illuminate the light source with adjustment components under the control of a user to vary the intensity of the light source during the rotation of the blades.

2. An optical display device comprising:

a housing in a generally circular configuration with a c-shaped cross-section and a central axis;

a propeller formed of a plurality of blades mounted for rotational movement within the housing about an axis of rotation coincident with the central axis of the housing, each blade having exposed surfaces with fluorescent paint thereon;

a light source fixed within the housing in operative proximity to the blades disseminating light upon the blades;

a drive mechanism to rotate the blades; and a power source to illuminate the light source.

3. The device as set forth in claim 2 and further including adjustment mechanisms to vary the speed of rotation of the blades.

4. The device as set forth in claim 2 and further including adjustment components to vary the intensity of the light source.

5. The device as set forth in claim 2 and further including a knock-off hub adapted to removably secure the propeller to the housing, the knock-off hub having an interior light source for use in disseminating light upon the florescent paint of the blades.

* * * * *